US007708385B1

(12) United States Patent
Kim et al.

(10) Patent No.: US 7,708,385 B1
(45) Date of Patent: May 4, 2010

(54) INK-JET PRINT HEAD

(75) Inventors: Yong-Jae Kim, Gyeonggi-do (KR); Suk-Han Lee, Gyeonggi-do (KR); Jae-Yong Choi, Seoul (KR); Sang-Uk Son, Gyeongsangbuk-do (KR); Do-Young Byun, Seoul (KR); Han-Seo Ko, Seoul (KR); Ki-Chul An, Daegu (KR)

(73) Assignee: Sungkyunkwan University Foundation for Corporate Collaboration, Gyeonggi-Do (KR)

( * ) Notice: Subject to any disclaimer, the term of this patent is extended or adjusted under 35 U.S.C. 154(b) by 0 days.

(21) Appl. No.: 12/390,254

(22) Filed: Feb. 20, 2009

(30) Foreign Application Priority Data

Jan. 14, 2009 (KR) ..... 10-2009-0003086

(51) Int. Cl.
*B41J 2/06* (2006.01)

(52) U.S. Cl. ..... 347/55

(58) Field of Classification Search ..... 347/55, 347/44, 57, 75, 112; 399/135
See application file for complete search history.

*Primary Examiner*—Matthew Luu
*Assistant Examiner*—Lisa M Solomon
(74) *Attorney, Agent, or Firm*—James P. Muraff; Neal, Gerber & Eisenberg, LLP

(57) ABSTRACT

Disclosed is a multi-nozzle inkjet print head using an electrostatic field induced type. The inkjet print head in accordance with an embodiment of the present invention includes: a first electrode being formed in each nozzle; and a second electrode located on a side spaced from the nozzle and arranged to block between any two adjacent nozzles and inducing an electrostatic field for discharging ink from the nozzle by forming an electric potential difference between the first electrode and the second electrode.

25 Claims, 17 Drawing Sheets

$$F_g - F_{st} + F_e = 0$$

2D, +1mm, On-Off-On

2D, +1mm, On-On-On

INK-JET PRINT HEAD

CROSS-REFERENCE TO RELATED APPLICATIONS

This application claims the benefit of Korean Patent Application No. 10-2009-0003086, filed with the Korean Intellectual Property Office on Jan. 14, 2009, the disclosure of which is incorporated herein by reference in its entirety.

BACKGROUND

1. Technical Field

The present invention relates to an inkjet head, more particularly to a multi-nozzle inkjet print head using an electrostatic field induced type.

2. Description of the Related Art

Inkjet print heads can be classified into, depending on the driving method, a thermal jet type, a piezo type and an electrostatic field induced type. The thermal jet type discharges (ejects) ink by using the expansive force of a bubble generated at the time of heating the ink with a heater. The piezo type discharges ink by using the mechanical vibration or expansive force from a piezoelectric actuator including a piezoelectric material, which is expanded or contracted according to the applied voltage.

Because heating is used, the thermal jet type has limited ink materials and the amount of ejected ink is fixed. The manufacturing cost of the piezo type is higher due to the complicated structure, and the nozzles are often clogged due to the hardening of the ink.

The electrostatic field induced type discharges ink by using the electrostatic attraction induced between electrodes. Compared to the types described above, the electrostatic field induced type has a simpler structure and lower power consumption. However, with the increasing demand for high resolution print quality and high-speed printing, the inkjet print head of the electrostatic field induced type, which has multi-nozzles (that is, a plurality of nozzles), has increasingly suffered with an interference (that is, crosstalk occurrence) caused by an electrostatic field between adjacent nozzles.

High density and high integration of an inkjet print head are indispensable for high resolution print quality and high-speed printing. With regard to this matter, as a separation distance between adjacent nozzles becomes smaller, the electric field interference between adjacent nozzles becomes severer, harming the independent drive of each nozzle. Accordingly, in order to make it possible to independently operate the nozzles at a high speed and to discharge ink to an accurate position, it is necessary that the electric field interference be solved in the inkjet print head of the electrostatic field induced type, which has multi-nozzles.

Additionally, the conventional inkjet print head of the electrostatic field induced type uses a method of applying a driving voltage between a discharge electrode located around the nozzles and a facing electrode located to face the nozzles (see the left-side figures of FIGS. 8*a* and 8*b*). However, according to the conventional inkjet print head of the electrostatic field induced type, the facing electrode increases the total size and volume of the apparatus and complicated the connection structure of a driving circuit.

SUMMARY

The present invention provides an inkjet print head of an electrostatic field induced type, which has a plurality of nozzles. The inkjet print head is capable of preventing crosstalk by shielding electric field interference between adjacent nozzles.

Besides, among the inkjet print head of an electrostatic field induced type, which has a plurality of the nozzles, Other objects in addition to the objects mentioned above of the present invention can be easily understood with the following description.

An aspect of the present invention features an inkjet print head of an electrostatic field type, which has a plurality of nozzles. The inkjet print head in accordance with an embodiment of the present invention can include: a first electrode being formed in each nozzle; and a second electrode located on a side spaced from the nozzle and arranged to block between any two adjacent nozzles and inducing an electrostatic field for discharging ink from the nozzle by forming an electric potential difference between the first electrode and the second electrode.

Here, the first electrode is formed either by coating at least a part of the surface of the nozzle with a conductive material or by manufacturing at least a part of the nozzle with a conductive material.

Another aspect of the present invention features an inkjet print head of electrostatic field induced type, which has a plurality of nozzles. The inkjet print head in accordance with an embodiment of the present invention can include: a first electrode formed to be in contact with ink to be discharged through the nozzle; and a second electrode located on a side spaced from the nozzle and arranged to block between any two adjacent nozzles and inducing an electrostatic field for discharging ink from the nozzle by forming an electric potential difference between the first electrode and the second electrode.

Here, the first electrode can be disposed for each nozzle.

The mentioned inkjet print head of the present invention can include the characteristics described below.

In an embodiment of the present invention, the second electrode can be located on both sides spaced from the nozzle.

In an embodiment of the present invention, the second electrode can be arranged to surround the sides of the nozzle from every direction. The second electrode can be manufactured to have a rectangular pillar shape. The second electrode can be manufactured to have a cylindrical shape around the nozzle, the cylindrical shape having an identical radius.

In an embodiment of the present invention, the second electrode is also located on the front side of the nozzle, whereas an opening can be formed at a part of the second electrode of the front side of the nozzle, the part corresponding to a position of an ink discharge port of the nozzle.

In an embodiment of the present invention, an end of the nozzle in a direction of discharging the ink can be located to be lower than an end of the second electrode.

In an embodiment of the present invention, the inkjet print head further includes a driving circuit for supplying a driving electric power to the first electrode and the second electrode, whereas the driving circuit can individually supply a discharge voltage for discharging the ink to the first electrode for each nozzle and supply a ground voltage to the second electrode.

In an embodiment of the present invention, the inkjet print head further includes a driving circuit for supplying a driving electric power to the first electrode and the second electrode, whereas the driving circuit can individually supply a discharge voltage for discharging the ink to the second electrode for each nozzle and supply a ground voltage to the first electrode.

In an embodiment of the present invention, the plurality of the nozzles can be arranged in a line spaced from one another at regular intervals. The plurality of the nozzles can be two-dimensionally arranged to be spaced from one another.

DETAILED DESCRIPTION

The description that follows describes, illustrates and exemplifies one or more particular embodiments of the present invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the present invention is intended to cover all such embodiments that may fall within the scope of the appended claims, either literally or under the doctrine of equivalents.

In the following description of the present invention, the detailed description of known functions and configurations incorporated herein is omitted when it may make the subject matter of the present invention rather unclear. Numbers used for description of the present invention (for example, the first and the second, etc) are merely identification symbols for distinguishing one element from another.

In the present invention, an inkjet print head of an electrostatic field induced type, which has multi-nozzles, includes a first electrode either being formed in each of the nozzles or being formed to be in contact with ink to be discharged through the nozzle, a second electrode, which is located on multi-sides separately from the nozzle and arranged to block between some two adjacent nozzles, and inducing an electrostatic field for discharging ink from the nozzle by generating an electric potential difference between the first electrode and the second electrode.

Thus, in comparison with the fact that an inkjet print head of an existing electrostatic field induced type has a facing electrode structure constituted by a discharge electrode and a facing electrode located to face the discharge electrode, the first feature of the present invention is that an electrode structure adopted by the present invention is a side electrode structure (but not precluding a case of further including a front electrode, which will be described below, throughout the remaining description) formed by the first electrode and the second electrode located on the side of the first electrode.

The second feature of the present invention is that the second electrode located on the side of the first electrode performs a function of a shielding wall for preventing crosstalk caused by an electric field interference between adjacent nozzles as well as a function of an electrode only for supplying the electric power.

Figure 5:
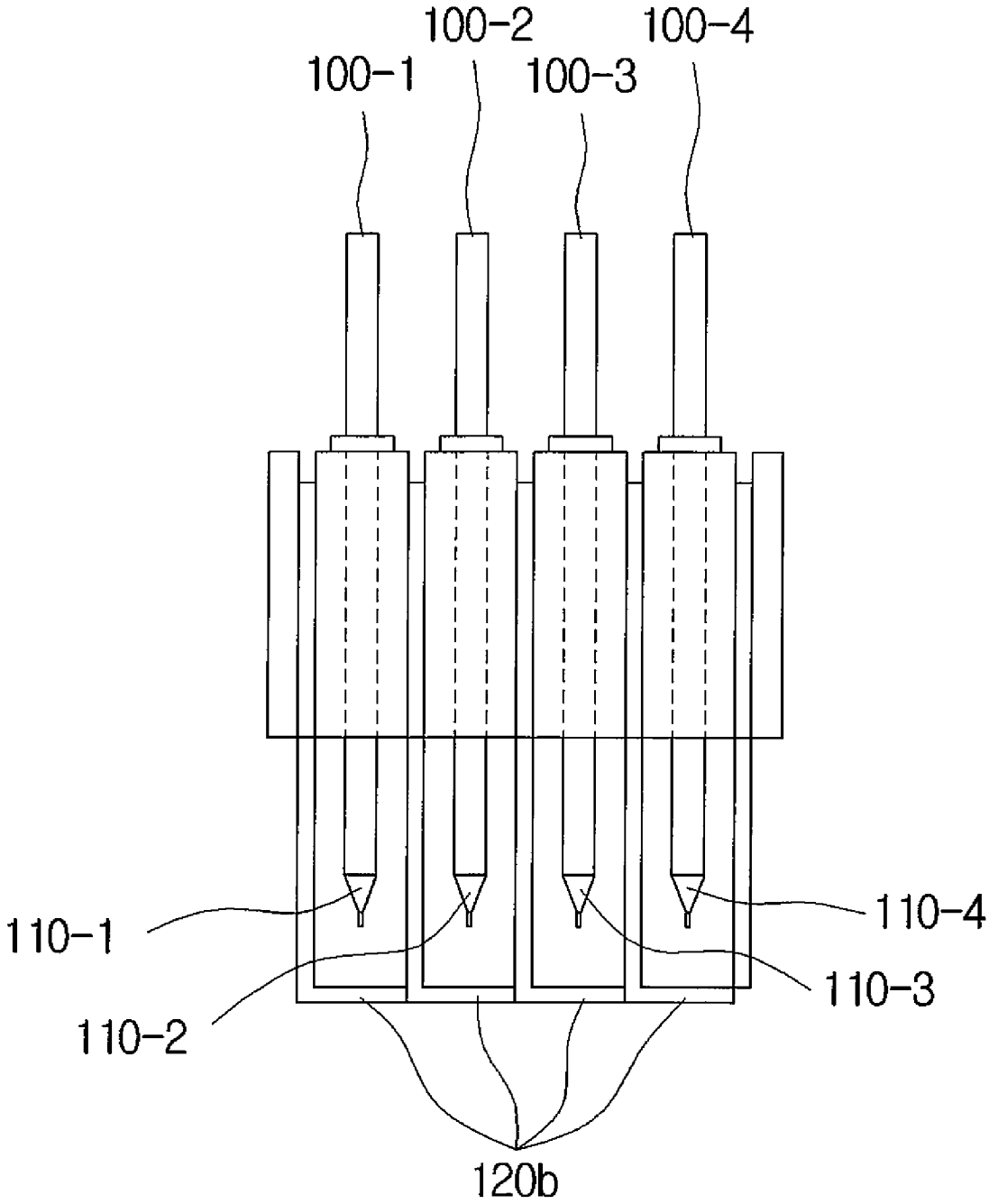
FIG. 5 is a cross-sectional view of a side of an inkjet print head shown in FIG. 4 as viewed from one direction.
Figure 6:
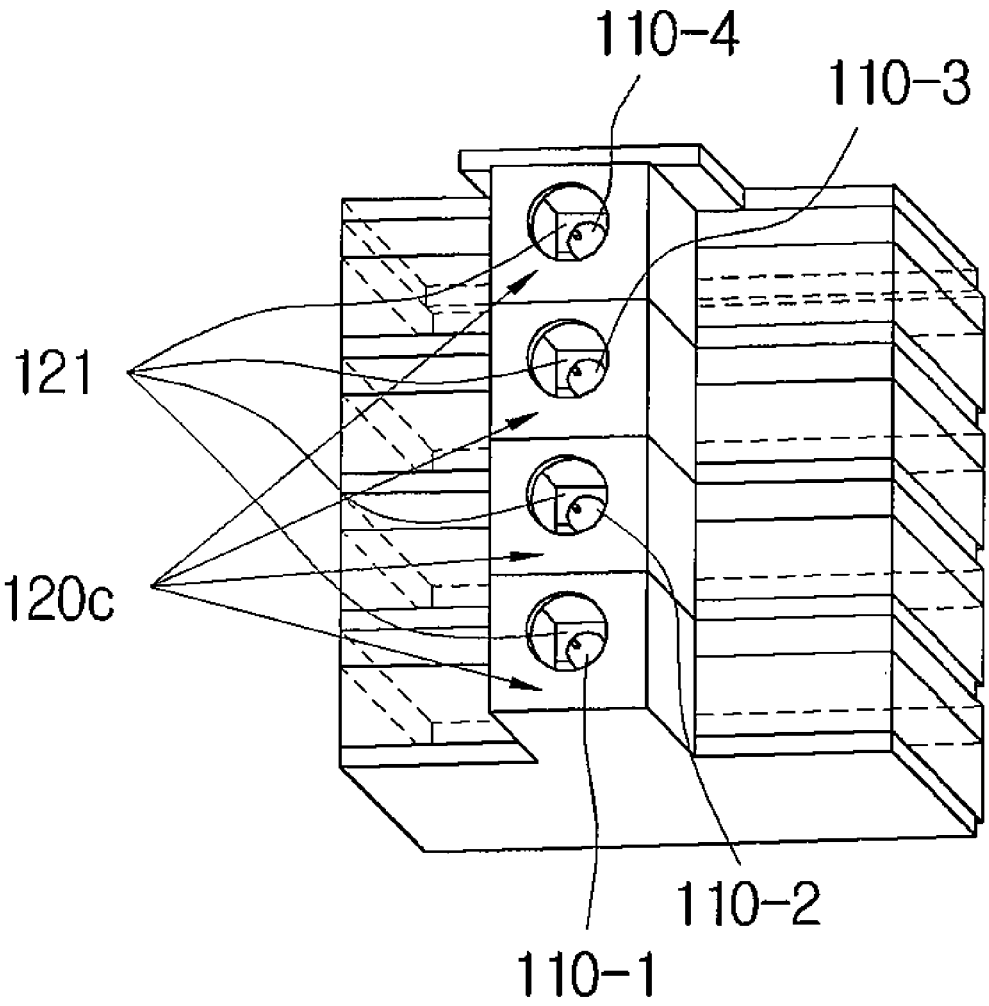
FIG. 6 is a perspective view schematically showing a configuration of an inkjet print head according to still another embodiment of the present invention.

The second electrodes having such features can be arranged only on both sides of the first electrode (see FIGS. 1 and 2), can be manufactured to surround all sides of the first electrode so as to improve the shielding efficiency (see FIG. 3), can be manufactured to arranged not only on both sides but on the front side of the first electrode (see FIGS. 4 and 5), or can be manufactured to arranged not only on all sides but on the front side of the first electrode (see FIG. 6). In addition, the second electrode can be manufactured to have a cylindrical shape for obtaining a balance or symmetry of electrostatic attraction to be formed between the first electrodes (see the right-side picture of FIG. 8*a*).

Hereinafter, while various embodiments of the inkjet print head according to the present invention will be described one by one with reference to the accompanying drawings, the description thereof that can be repetitive by respective embodiments will be omitted.

Figure 1:
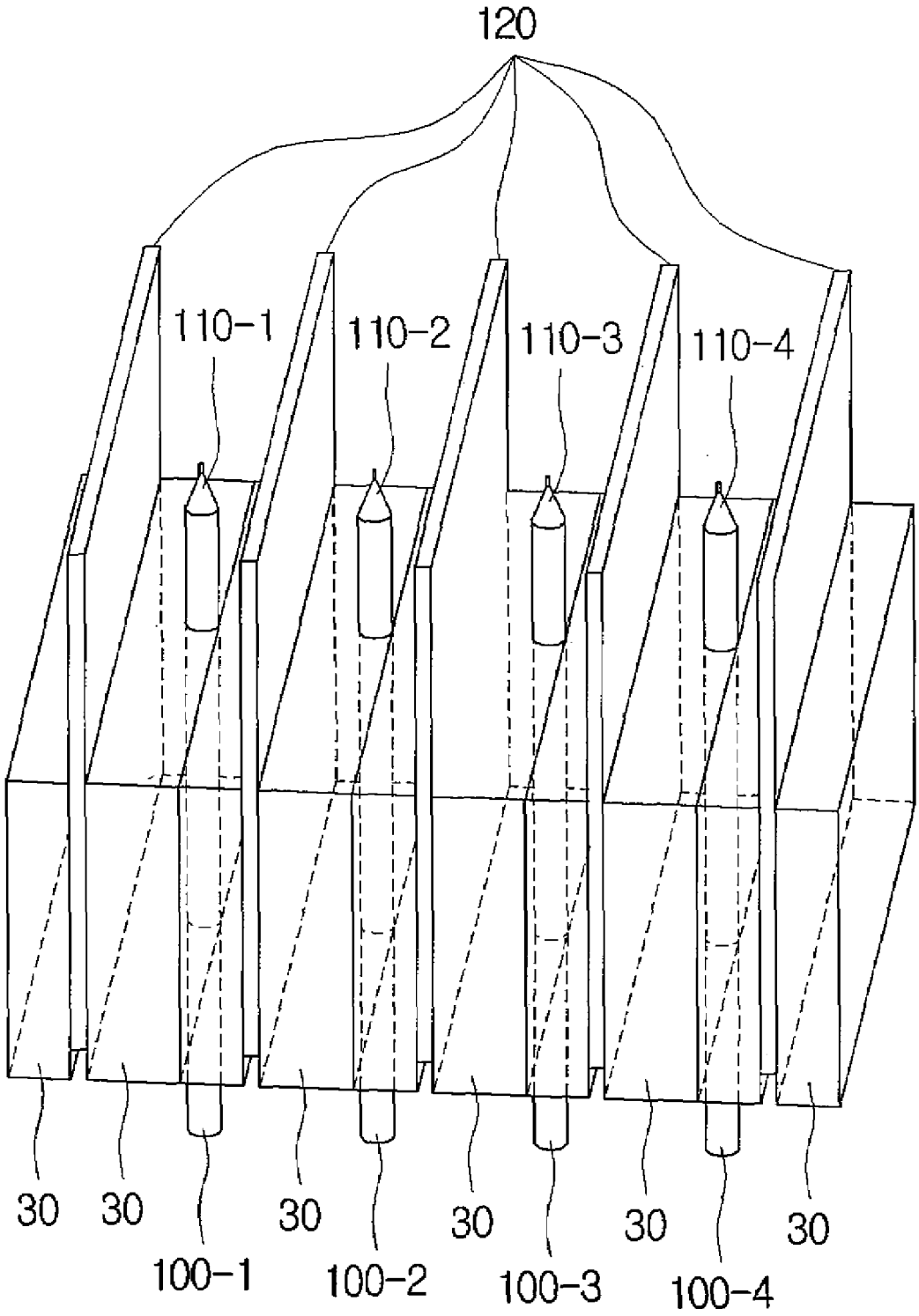
FIG. 1 is a perspective view schematically showing a configuration of an inkjet print head according to an embodiment of the present invention.
Figure 2:
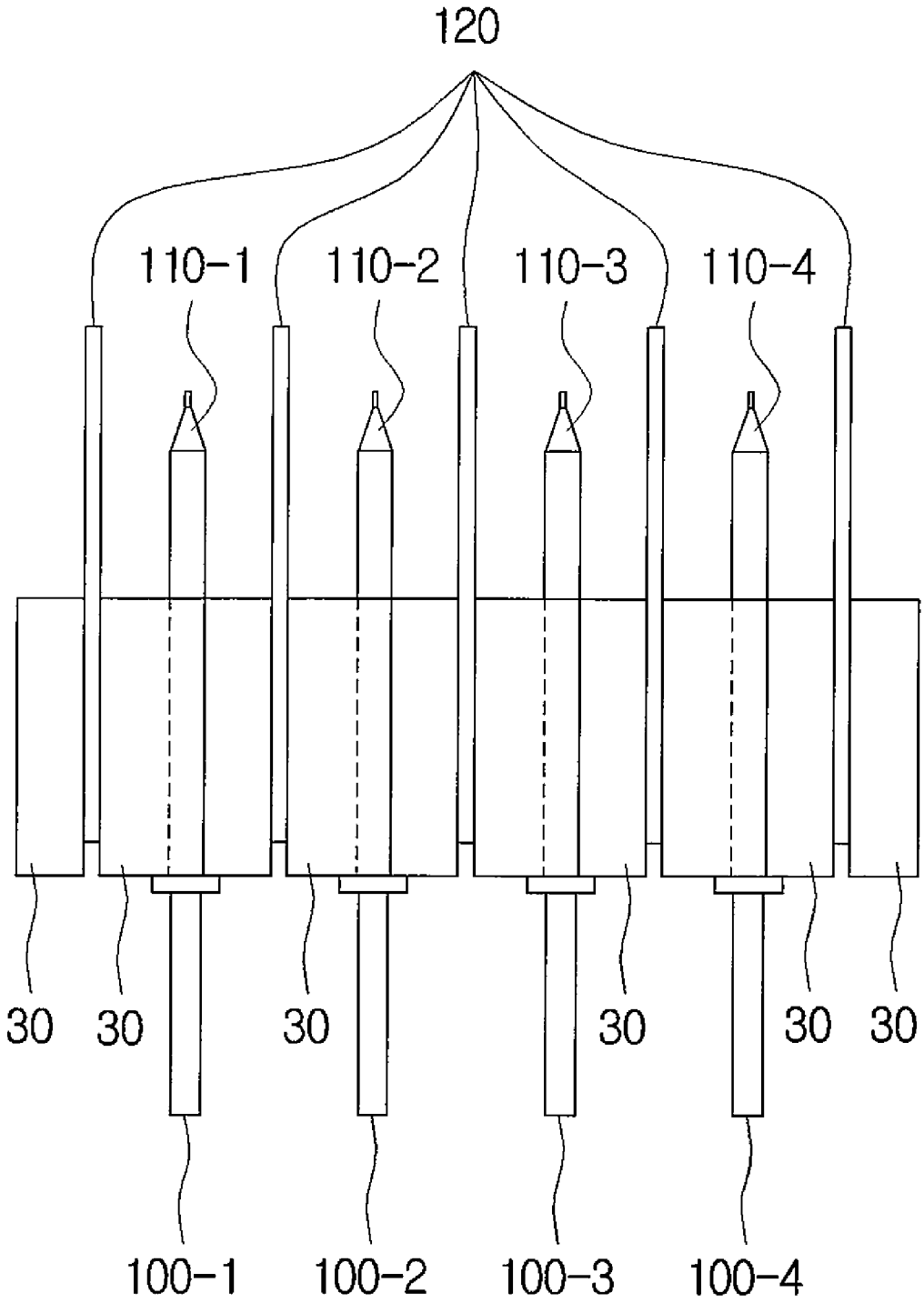
FIG. 2 is a cross-sectional view of a side of an inkjet print head shown in FIG. 1 as viewed from one direction.

FIG. 1 is a perspective view schematically showing a configuration of an inkjet print head according to an embodiment of the present invention. FIG. 2 is a cross-sectional view of a side of an inkjet print head shown in FIG. 1 as viewed from one direction.

In FIGS. 1 and 2, an inkjet print head according to an embodiment of the present invention includes a plurality of nozzles 100-1, 100-2, 100-3 and 100-4, first electrodes 110-1, 110-2, 110-3 and 110-4, each of which is formed in each of the plurality of nozzles 100-1, 100-2, 100-3 and 100-4 respectively, and a second electrode 120 located in each space between some two adjacent nozzles.

The inkjet print head shown in FIGS. 1 and 2 (FIGS. 3 through 6 are the same as this) is illustrated to have an insulation material 30 interposed in each space between two adjacent second nozzles 120. However, it can be clearly understood by those skilled in the art that this is only an illustration of a device configuration and such a configuration is not necessarily provided.

For example, the inkjet print head according to an embodiment of the present invention can be implemented not only by a mechanical connection but also by the microelectromechanical system (MEMS) technology.

Besides, from a similar point of view to this matter, while FIGS. 1 and 2 focus only on the nozzle, the first electrode and the second electrode, it is apparent that other components constituting the inkjet print head are not to be excluded. In other words, since FIGS. 1 and 2 focus only on components that is directly related to essential features of the present invention for the convenience of illustration, other components (for example, an ink supplier, a driving circuit, a driving controller and a head transporter, etc.) necessary for normally operating the inkjet print head can be also included. Since well known components can be applied to the inkjet print head of the present invention as they are, the detailed description thereof will be omitted.

Moreover, it is assumed that only four nozzles are shown for the convenience of the drawings and they are arranged in a line separately from each other at the same interval in FIGS. 1 and 2 (FIGS. 3 through 6 are the same as this).

However, the inkjet print head having multi-nozzles can have a greater number of nozzles. Moreover, various nozzle arrangement methods (for example, a method of arranging the multi-nozzles two-dimensionally in various types such as an n by n matrix, etc.) can be also adopted. In those cases, the second electrode arrangement method in the present invention can be also variously changed corresponding to the number of the nozzles that are included in the inkjet print head and an adopted method of arranging the nozzles. However, for the convenience of the description, the following description will focus on the inkjet print head of the present invention having the nozzle arrangement method illustrated in the drawing.

In an embodiment of the present invention, each of the first electrodes 110-1, 110-2, 110-3 and 110-4 is formed in each of the nozzles 100-1, 100-2, 100-3 and 100-4, respectively. This is for independently driving (operating) each nozzle. That is, unlike a conventional electrode, each of the first electrodes 110-1, 110-2, 110-3 and 110-4 of an embodiment of the present invention is formed in each of the nozzles, respectively, instead of being formed around an ink discharge port of each nozzle.

To this end, the first electrode can be formed by coating at least a part of the nozzle surface (for example, an ink discharge part and/or a part of the nozzle adjacent to the ink discharge part) or at least a part of the surface inside the nozzle with a conductive material. Moreover, either the nozzle itself or at least a part of the nozzle is manufactured to have a conductive material so that the part can be used as the first electrode as it is. Here, it shall be evident that the conductive material/substance is generally not only a metallic material having high electric conductivity but also any other well-known material having electric conductivity that can be used as an electrode material.

That is, since the inkjet print head according to an embodiment of the present invention has the first electrode formed in the nozzle itself, it is not necessary to separately have a nozzle and an electrode, unlike the conventional inkjet print head. As a result, the inkjet print head is capable of simplifying the device configuration thereof, and the same is true for FIGS. 3 through 6 to be described below.

In an embodiment of the present invention, the second electrodes 120 are arranged on both sides of each of the nozzles 100-1, 100-2, 100-3 and 100-4, respectively, as shown in FIGS. 1 and 2, spatially isolating/separating any two adjacent nozzles.

That is, in the embodiment of the present invention, the second electrode 120 forms an electric potential difference between the first electrode and the second electrode, performing not only a function of an electrode for inducing an electrostatic field for discharging the ink from the nozzle, but a function of a shielding wall for preventing crosstalk caused by electric field interference generated between adjacent nozzles during the process of independently driving each of the nozzles 100-1, 100-2, 100-3 and 100-4.

Figure 8A:
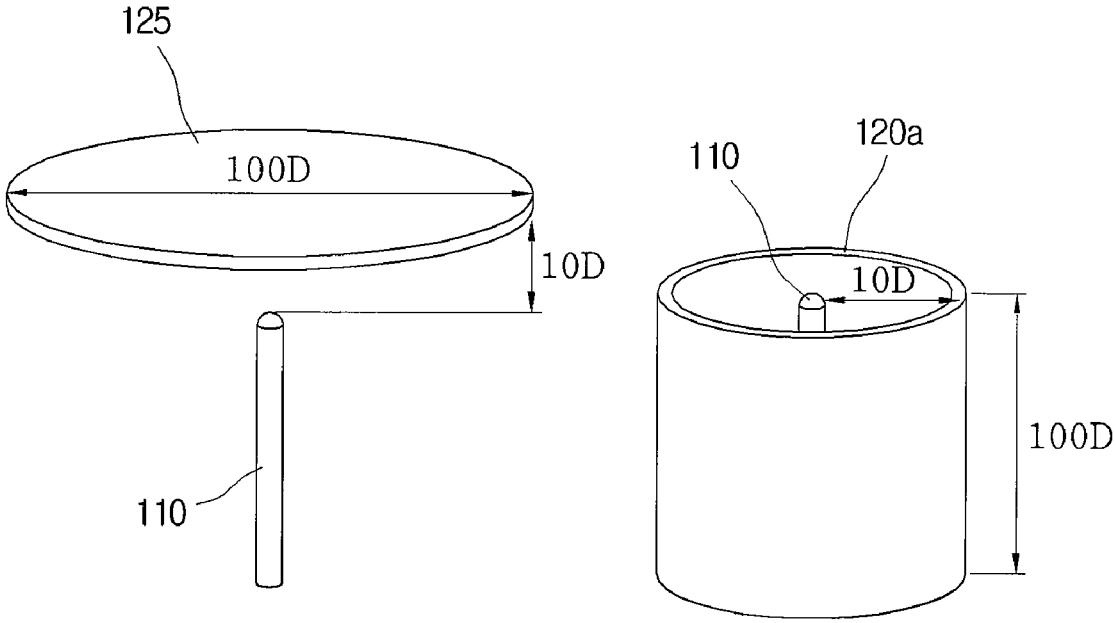
FIGS. 8*a* and 8*b* show a comparison of a conventional electrode structure of an inkjet print head of an electrostatic field induced type and an electrode structure based on an embodiment of the present invention.
Figure 8B:
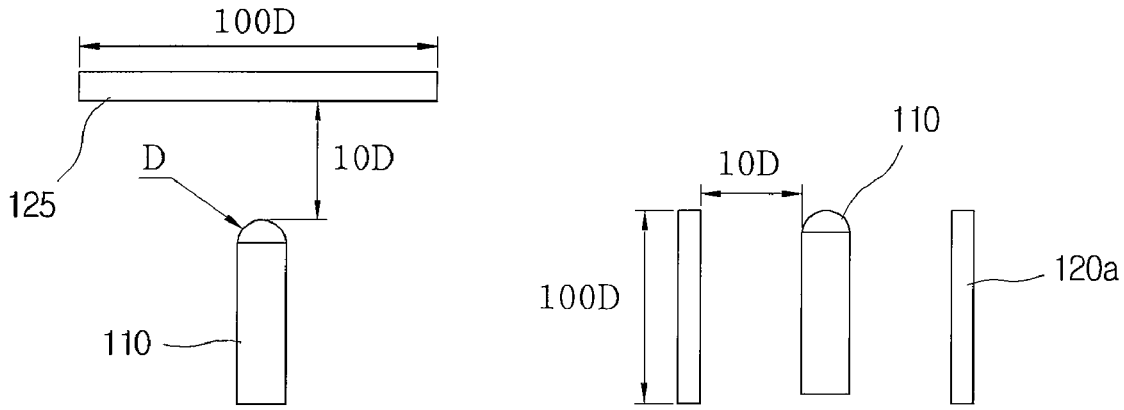

Since the inkjet print head of the conventional electrostatic field induced type, similarly to the left-side figures of FIGS. 8*a* and 8*b*, has a facing electrode structure in which an electrode is arranged in a position facing the front of the nozzle, a separate physical barrier and the like had to be placed around the nozzle in order to prevent the crosstalk mentioned above between adjacent nozzles. This has been a factor causing the overall device configuration and design thereof complicated/complex, and brought about a low shielding efficiency on the electric field interference.

By contrast, in the present invention, since the second electrode 120 itself performs a function of a shielding wall for preventing the electrostatic interference between adjacent nozzles, it is not necessary to separate the electrode and the shielding wall. Therefore, it is possible to acquire the simplicity of the device configuration and design, and to improve the shielding efficiency thereof. This is because the present invention has an electrode arrangement structure in which the electric field is generated between the first electrode and the second electrode located on the side of the first electrode, unlike the fact that an existing electrode arrangement structure in which the electric field is generated between the discharge electrode around the nozzle and the facing electrode located to face the discharge electrode (for example, see reference numeral 125 on the left side of FIGS. 8*a* and 8*b*). That is, since the present invention has a special electrode arrangement structure of a side electrode structure, the influence (possibility) itself of the electric field interference on the adjacent nozzle is necessarily lower than that of the conventional facing electrode structure. Additionally, that the part itself functioning as a shielding wall in the present invention is an electrode to which voltage is supplied works to improve the efficiency of shielding the electric field interference.

The principle of the electric field interference shielding by the second electrode mentioned above is equally applied to an inkjet print head according to other embodiments shown in FIGS. 3 through 6 of the present invention. Hereinafter, while other embodiments of the present invention will be described with reference to FIGS. 3 through 6, redundant description of FIGS. 1 and 2 will be omitted and the following description will focus on the difference (that is, an arrangement method of the second electrode and the difference of shapes) from FIGS. 1 and 2.

Figure 3:
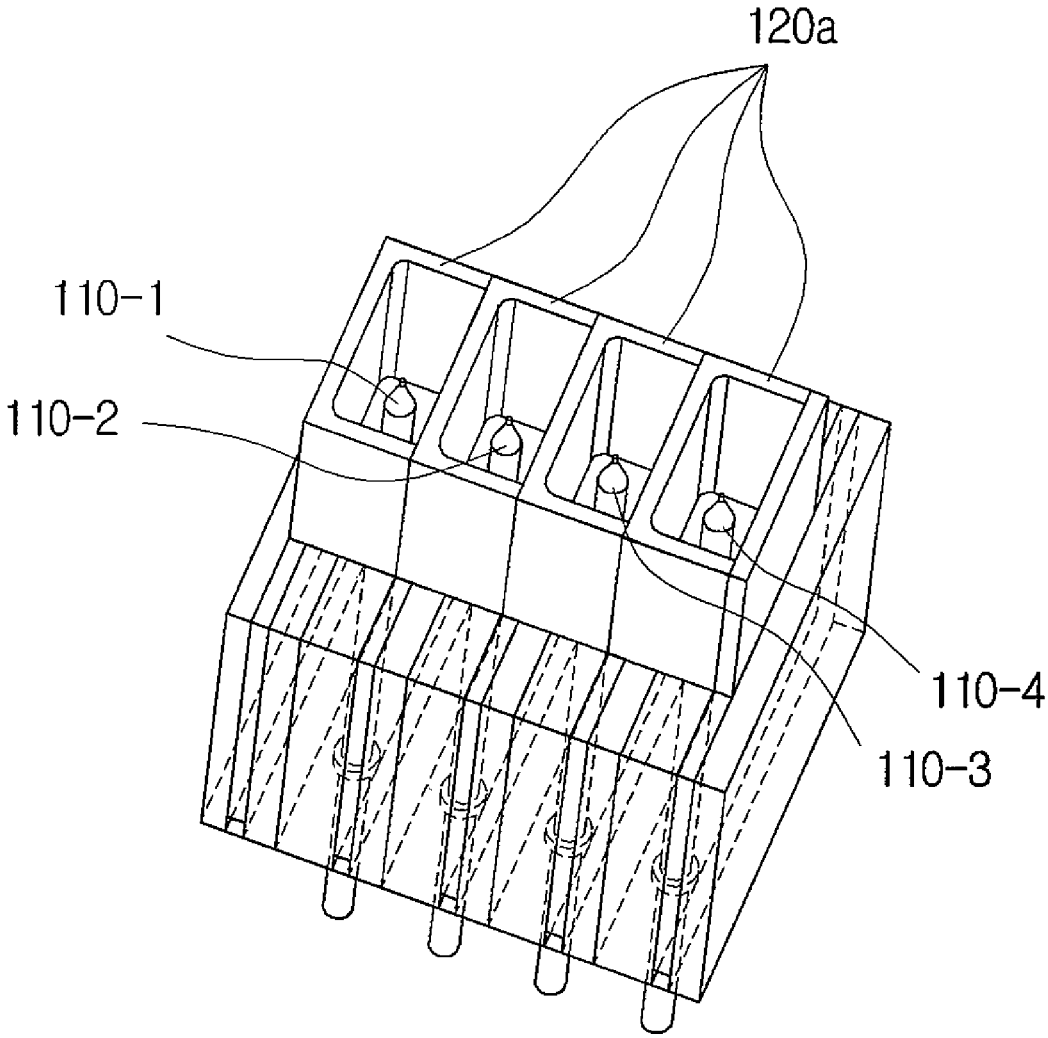
FIG. 3 is a perspective view schematically showing a configuration of an inkjet print head according to another embodiment of the present invention.
Figure 4:
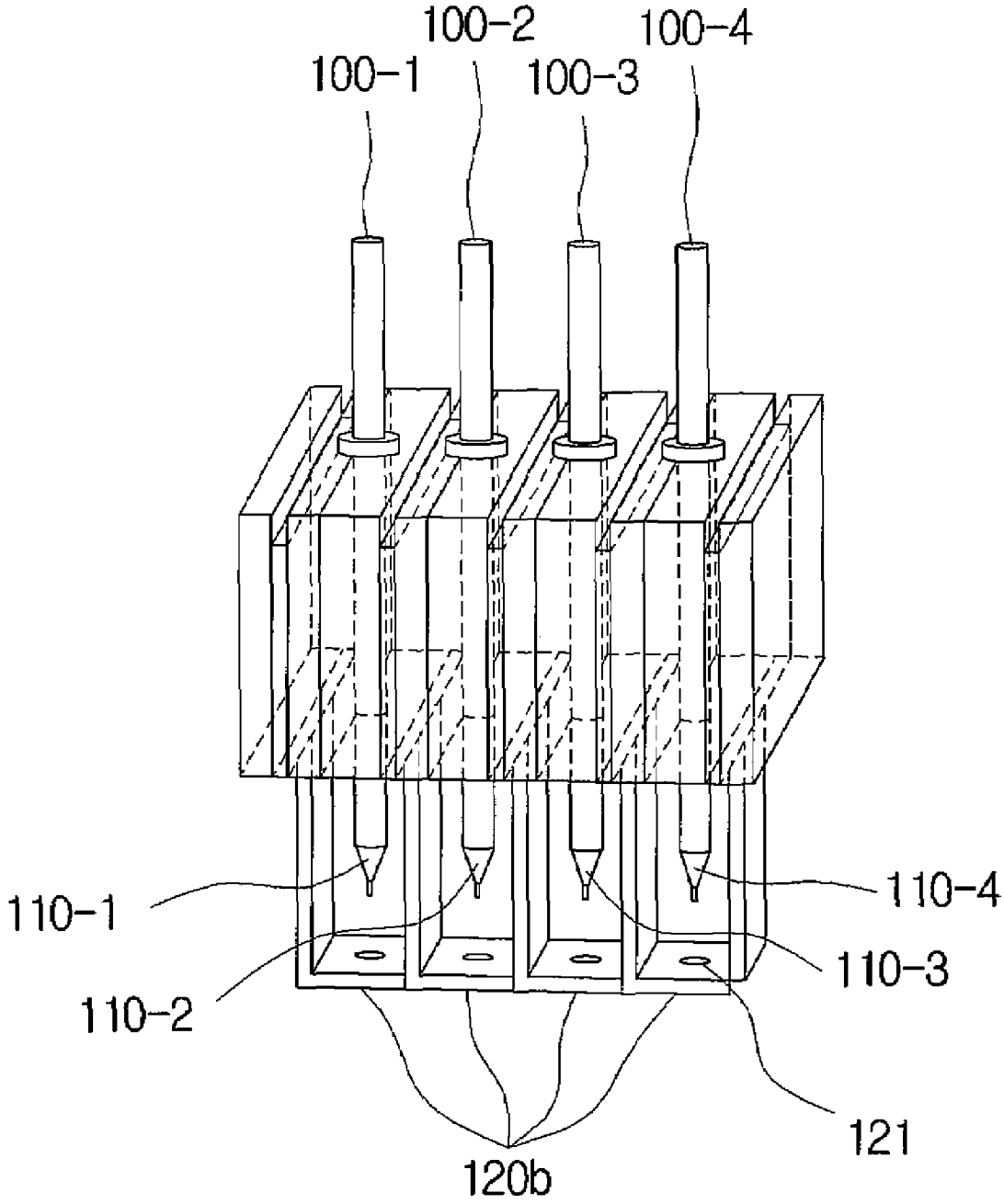
FIG. 4 is a perspective view schematically showing a configuration of an inkjet print head according to yet another embodiment of the present invention.

FIG. 3 is a perspective view schematically showing a configuration of an inkjet print head according to another embodiment of the present invention. FIG. 4 is a perspective view schematically showing a configuration of an inkjet print head according to yet another embodiment of the present invention. FIG. 5 is a cross-sectional view of a side of an inkjet print head shown in FIG. 4 as viewed from one direction. FIG. 6 is a perspective view schematically showing a configuration of an inkjet print head according to still another embodiment of the present invention.

First, in FIG. 3, comparing the inkjet print head according to another embodiment of the present invention with the inkjet print head of FIGS. 1 and 2, the inkjet print head of FIG. 3 has an arrangement method different from that of the second electrode of FIGS. 1 and 2.

In FIG. 3, the second electrode 120*a* not only has the same side electrode structure as that of the second electrode 120 of FIGS. 1 and 2, but also is located on all sides of each of the nozzles 100-1, 100-2, 100-3 and 100-4, having a feature of spatially isolating any two adjacent nozzles, thus improving the shielding efficiency on the electric field interference, as compared with the shielding efficiency when the second electrode 120*a* is located on both sides of the nozzle.

In FIG. 3, the second electrode 120*a* is illustrated to have a rectangular pillar shape. However, as long as the second electrode 120*a* is arranged to surround the nozzle entirely from the side by being located on all sides of each nozzle, the second electrode 120*a* can be manufactured to have a different shape from the shape mentioned above. For example, the second electrode 120*a* can have a polygonal pillar shape, such as a triangular pillar shape, a hexagonal pillar shape and the like, as well as a cylindrical shape. The second electrode 120*a* can be also manufactured such that the upper surface has a different area or diameter from the lower surface or the surface of the pillar is curved instead of being straight.

However, in case the second electrode is manufactured to have a rectangular pillar shape, it is easier to design/manufacture the second electrode in one body and boundary surfaces of adjacent electrodes can be in complete contact with each other, thus helping to implement a high density, high integration device.

In case the second electrode having a cylindrical shape of an identical radius is manufactured around one nozzle (see the right-side figure of FIG. 8*a*), the electrostatic force formed between the first electrode and the second electrode can be balanced/symmetrical.

The description mentioned above can be similarly applied to FIGS. 4 through 6 to be described below as well as applied to FIGS. 1 and 2 described above.

In FIGS. 4 through 6, the second electrode has another different feature from that of FIGS. 1 through 3 in that the second electrode is located on multi-sides and on the front side of the nozzle about each of the nozzles.

First, in FIGS. 4 and 5, the second electrode 120*b* has a feature of spatially isolating some two adjacent nozzles by being located on both sides and on the front side of the nozzle. In addition, in FIG. 6, the second electrode 120*c* is located on all sides and on the front side of the nozzle.

As such, if the second electrode, which performs functions of not only a shielding wall but also an electrode, is placed on the front side as well as on both sides of the nozzle, an electric field having a possibility of being transferred to an adjacent nozzle toward the front side of the nozzle can be shielded. Therefore, it is possible to improve the shielding efficiency on electric field interference.

Also, in the case mentioned above, because the second electrode is located on the front side as well as both sides of the nozzle, an electric field intensity of the case where the second electrode is located on the front side as well as both sides of the nozzle becomes higher than that of the case where the second electrode is located only on both sides of the nozzle, making it easier to discharge ink.

In addition, if the second electrode is located on the front side as well as both sides of the nozzle, it is also possible to block the effect of an electric field, which may be generated from the outside, as well as a printing object such as a substrate. Accordingly, the ink can be discharged more stably.

However, when the second electrode is located on the front side as well as both sides of the nozzle as described above, it is required that an opening 121 is formed at a part, corresponding to a position of the ink discharge port of the nozzle, of the second electrode located on the front side of each nozzle. Particularly, as shown in FIG. 6, since the second electrode 120*c* is manufactured to entirely surround the nozzle except for the opening 121, it can be easily inferred that the shielding efficiency thereof is maximized.

Hereinafter, how an inkjet print head is operated according to an embodiment of the present invention will be briefly described with reference to FIGS. 7*a* and 7*b*. How ink is discharged from an inkjet print head according to an embodiment of the present invention will be briefly described with reference to FIG. 7*c*. For the sake of convenience of the description, a nozzle is commonly designated as a reference numeral 100.

Figure 7A:
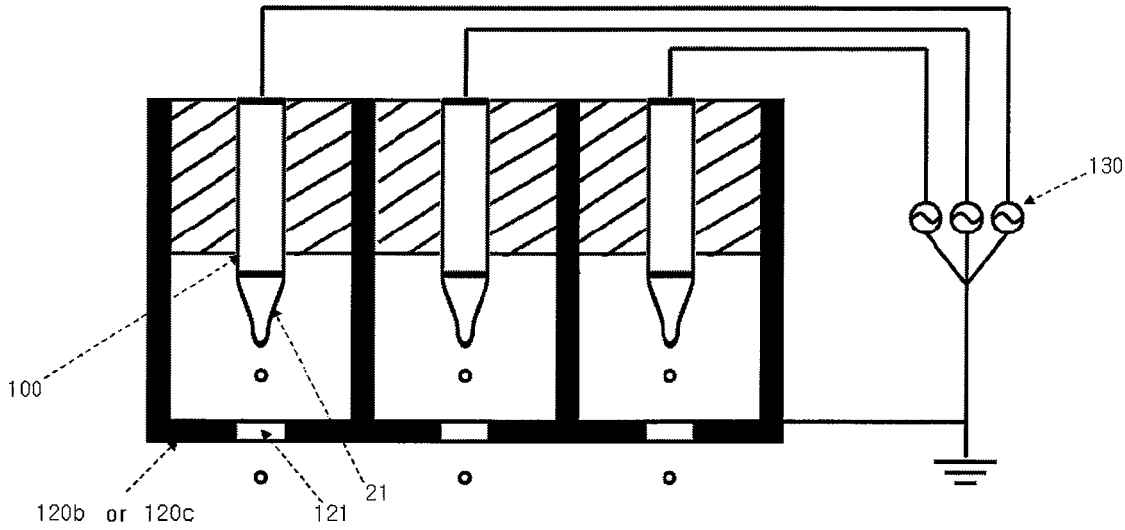
FIGS. 7*a* and 7*b* show how an inkjet print head is operated according to an embodiment of the present invention.
Figure 7B:
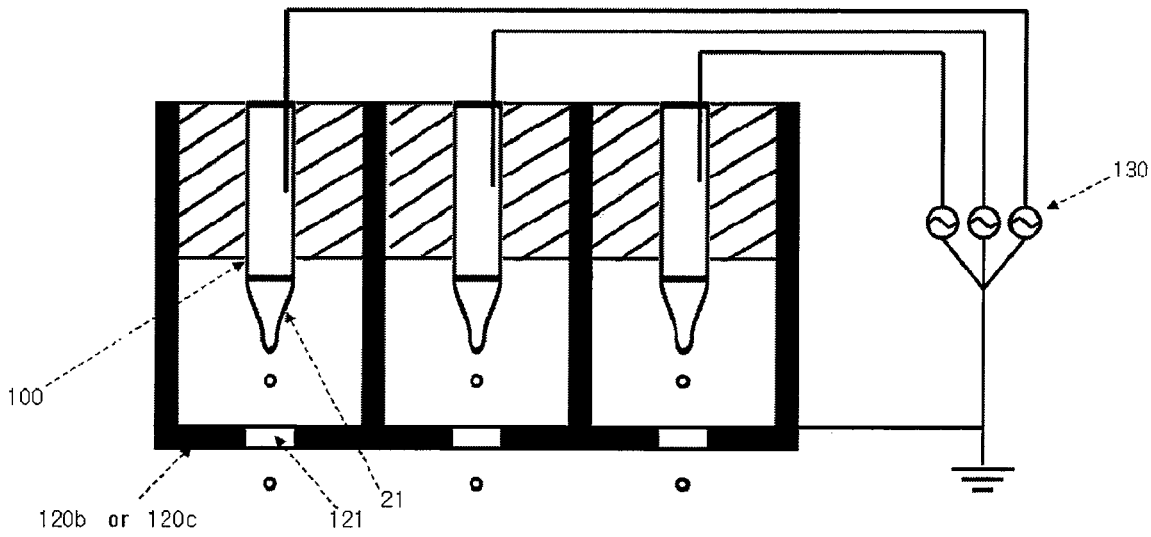

As described above in FIGS. 4 through 6, assuming an embodiment in which the second electrode is located on the front side as well as both sides of the nozzle, FIGS. 7*a* and 7*b* show that a driving voltage is supplied between the first electrode and the second electrode 120*b* or 120*c*.

Here, FIG. 7*a* shows that the first electrode is formed in each nozzle 100, and FIG. 7*b* shows that the first electrode is formed apart from each nozzle 100.

That is, while the illustration and description have focused on the case where the first electrode has been formed in the nozzle in said FIGS. 1 through 6 above, the first electrode is not necessarily formed in the nozzle itself. The first electrode can be formed in a part apart from the nozzle. In this case, the nozzle itself or a part of the nozzle cannot be necessarily made of or coated with a conductive material. For example, the nozzle itself can be manufactured with a dielectric material.

Accordingly, it is enough as long as the first electrode is in contact with the ink to be discharged through the nozzle, since the first electrode is only required to perform a function of discharging the ink. FIG. 7*b* shows this point clearly. At this point, the first electrode can be included in each nozzle as shown in FIG. 7*b* or can be included to be supplied with only one common voltage through an electric wire by being contained either in an entire reservoir reservoiring the ink or in an oil passage.

Figure 11A:
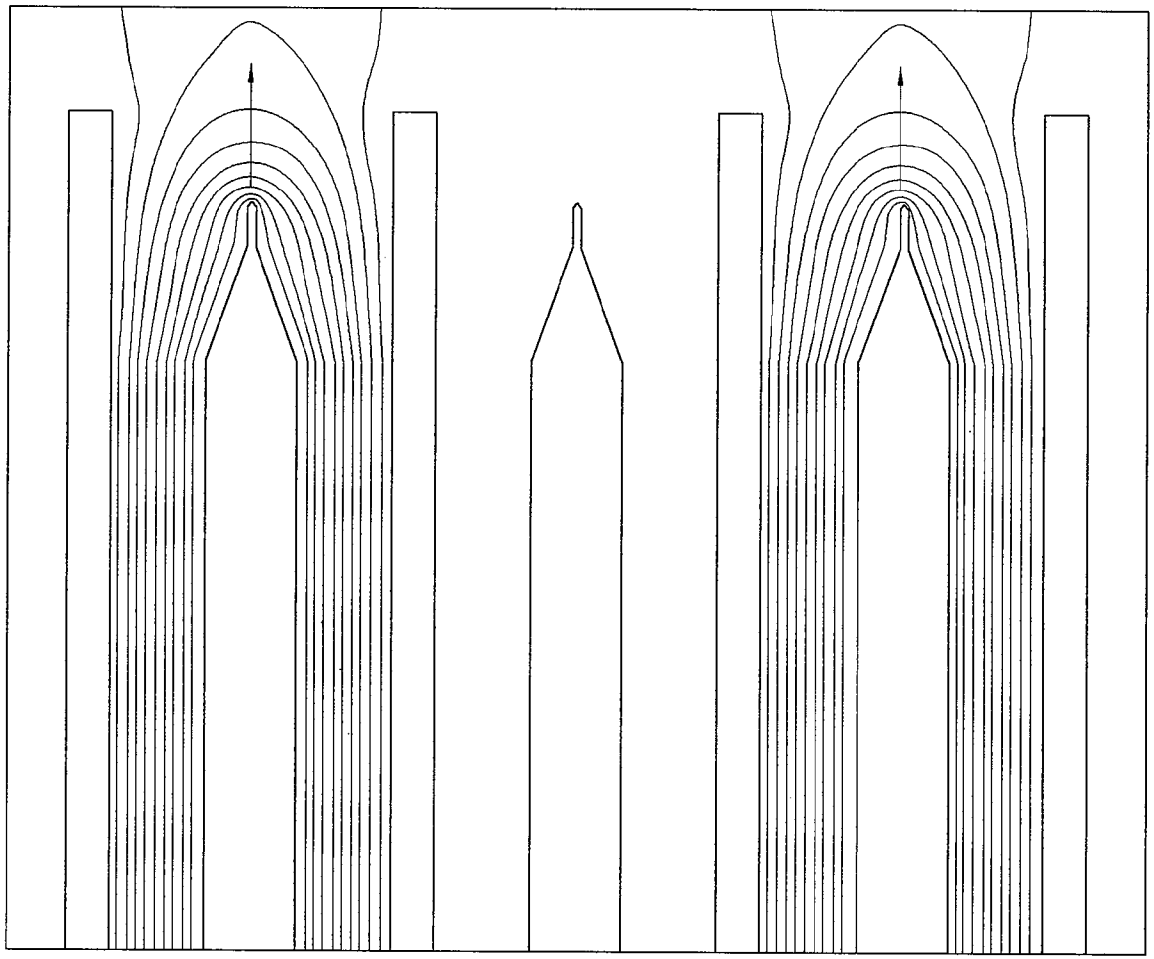
FIG. 11*a* shows equipotential lines on FIG. 10*a*.
Figure 11B:
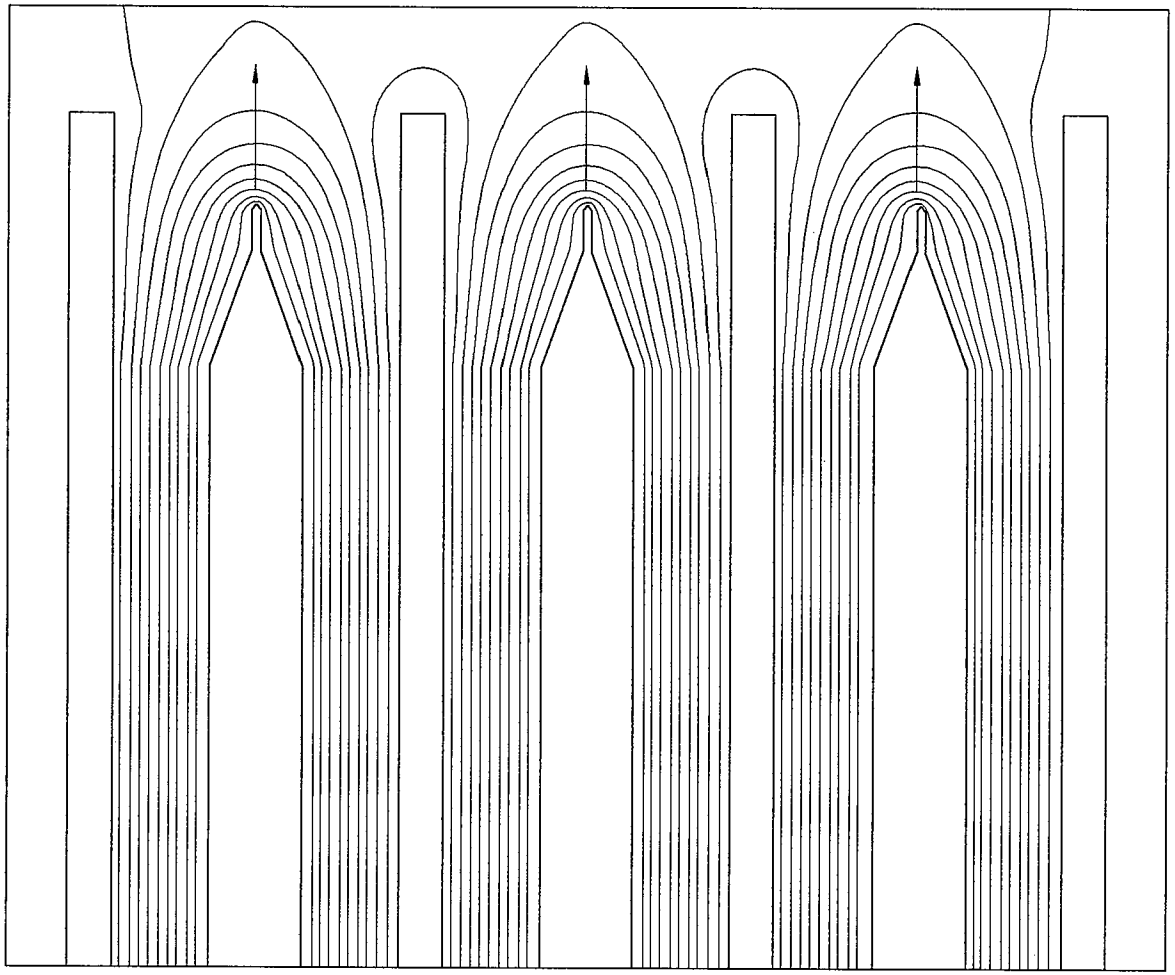
FIG. 11*b* shows equipotential lines on FIG. 10*b*.

As described above, since the side electrode structure of the present invention supplies a driving voltage between the first electrode and the second electrode located on the side of the first electrode (In FIGS. 7*a* and 7*b*, since the second electrode is located on the front side as well as on both sides of the nozzle, the voltage is also supplied to the second electrode located on the front side), the ink is discharged from the ink discharge part of the nozzle to a specific printing object to be placed on the front of the nozzle. This is also definitely cleared through FIGS. 11*a* and 11*b*.

Figure 10A:
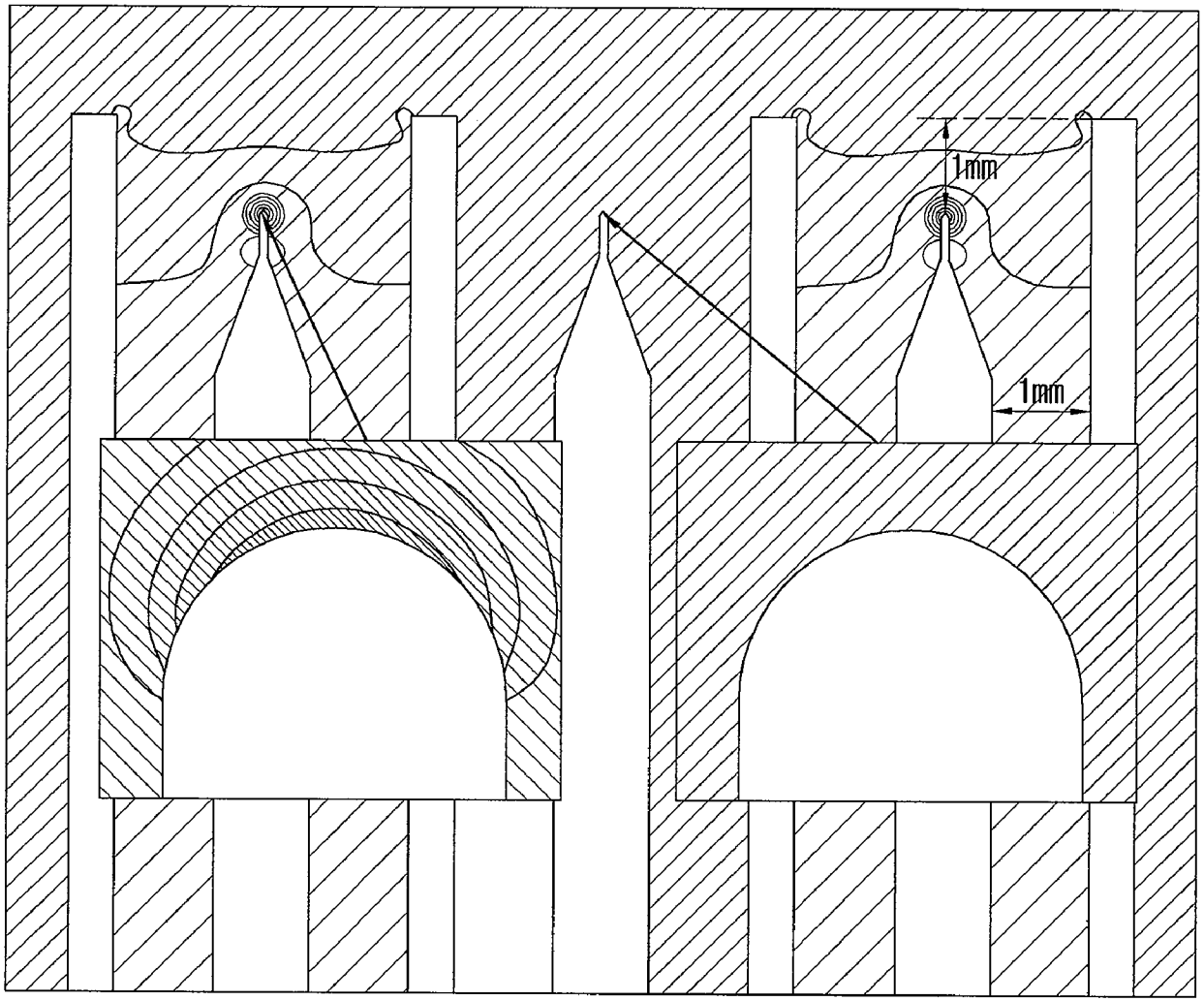
FIGS. 10*a* and 10*b* show simulation results of an electric field lines distribution appearing when operating a nozzle in an inkjet print head according to an embodiment of the present invention.
Figure 10B:
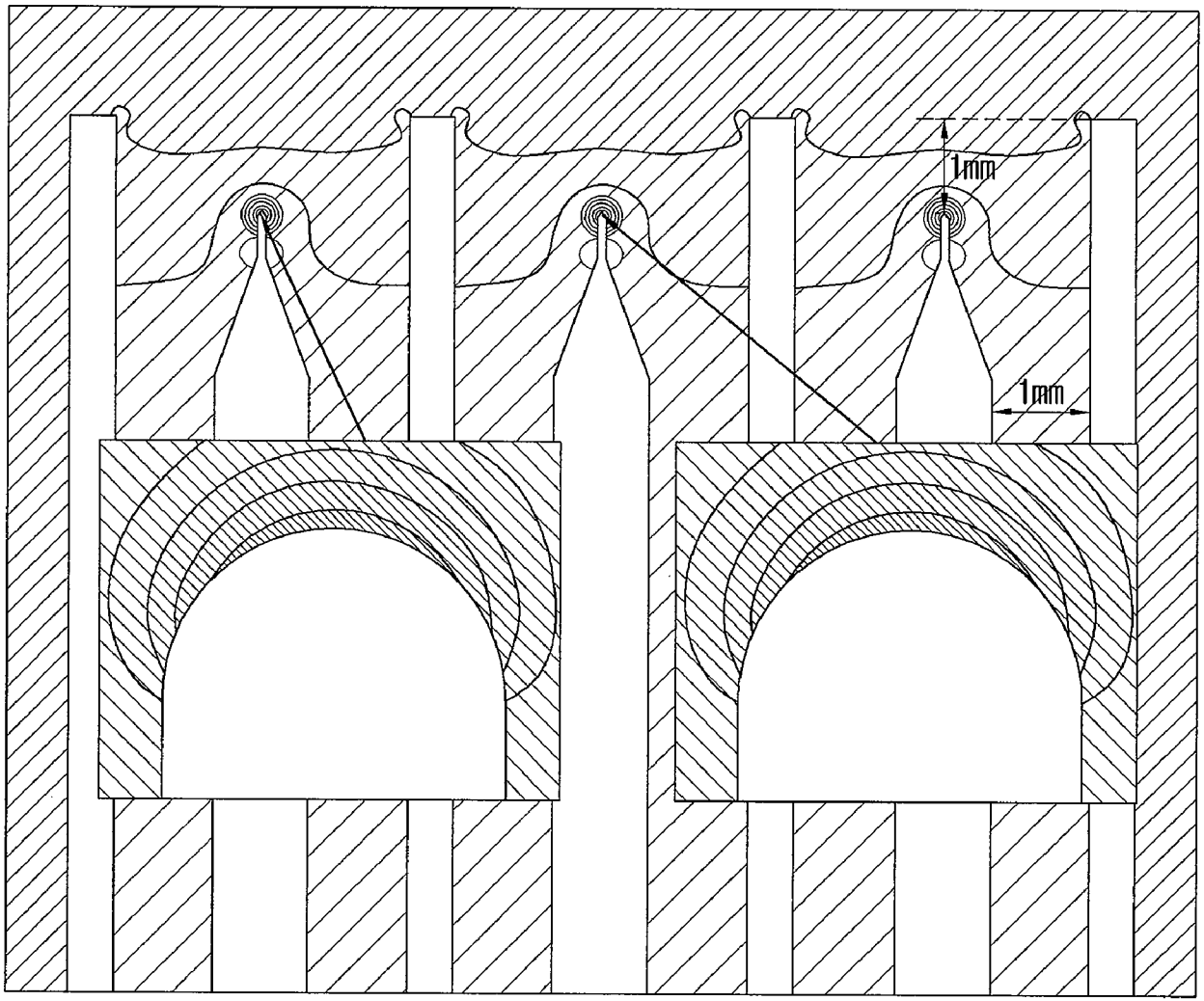

With respect to FIGS. 10*a* and 10*b*, FIGS. 11*a* and 11*b* show equipotential lines of FIGS. 10*a* and 10*b* respectively, which are generated between the nozzle (or the first electrode) and the second electrode. As shown in the equipotential line distributions of FIGS. 11*a* and 11*b*, an electrostatic attraction acts such that ink can be also discharged toward the front of the nozzle through the side electrode structure of the present invention, causing the ink to be discharged from the nozzle toward a printing object.

In accordance with variation (increase) of an electrostatic attraction induced between electrodes according to variation (increase) of a driving voltage supplied by a driving electric power 130, a meniscus 21 caused by an ink droplet being formed on the ink discharge part of an individual nozzle is sequentially varied. That is, as the electrostatic attraction between the electrodes is increased, the ink droplet being formed on the ink discharge part becomes thicker.

Here, the electrostatic attraction Fe is proportional to a square of the electric field intensity E as shown in the following equation.

$$F_e = \frac{1}{2} S \varepsilon_0 E^2, \quad \text{Equation}$$

where, S represents an area of a surface of the ink droplet on the assumption that the ink droplet to be discharged from the nozzle has a sphere shape. $\epsilon_0$ represents a dielectric constant of air.

That is, the electric field intensity has a direct influence on the discharge of the ink droplet. Therefore, it is possible to control the discharge of the ink droplet by adjusting the electric field intensity. On the other hand, because crosstalk between adjacent nozzles varies the electric field intensity, making it difficult to accurately control the ink discharge phenomenon. However, the side electrodes structure described in this specification is able to minimize the variation of the ink discharge phenomenon caused by the crosstalk.

Figure 7C:
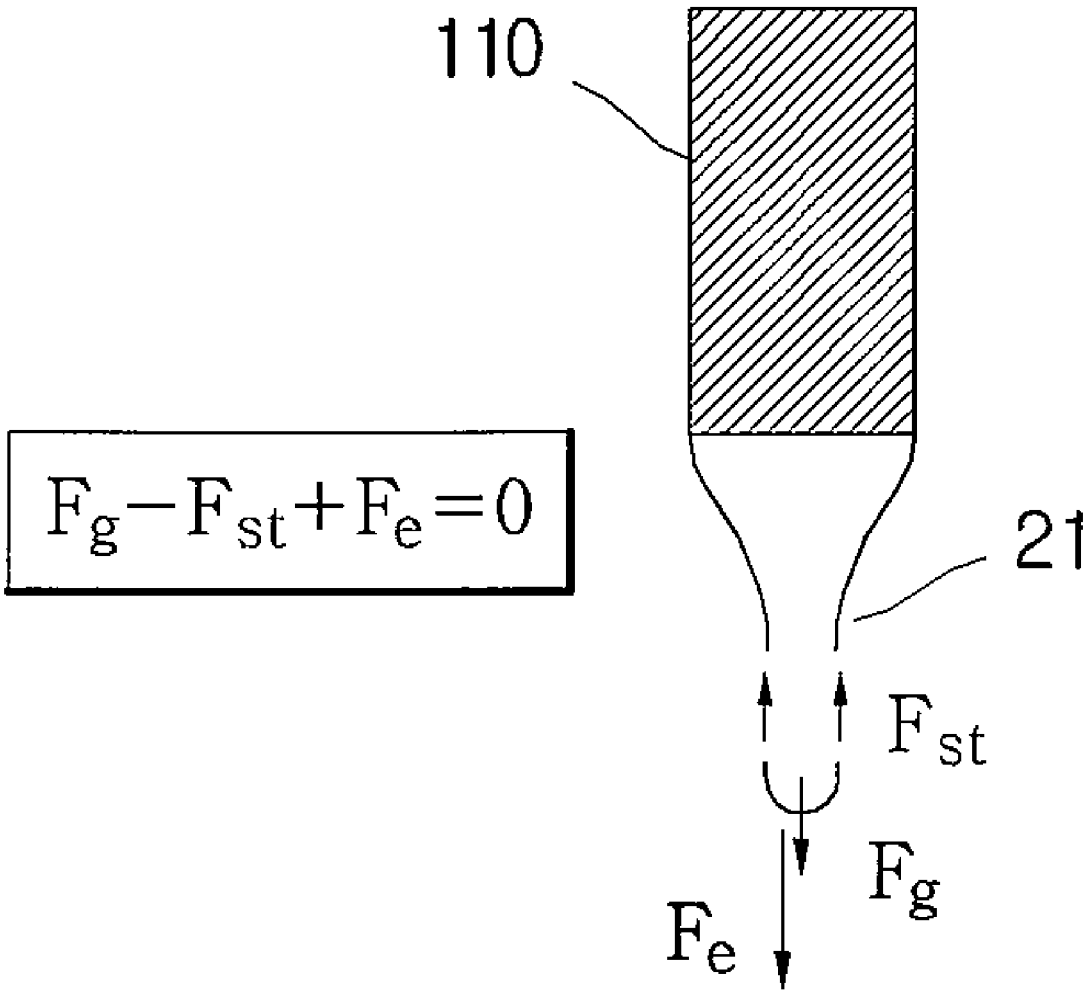
FIG. 7*c* shows how ink is discharged from an inkjet print head according to an embodiment of the present invention.

Through the principle as described above, an equilibrium state is maintained, as shown in FIG. 7*c*, between forces acting toward the dropping of the ink (that is, gravity $F_g$ and an electrostatic attraction $F_e$) and a force acting oppositely to the forces $F_g$ and $F_e$ as long as a part of the ink droplet formed on the ink discharge part is on the threshold of dropping. Such an equilibrium state is broken as the electrostatic attraction induced between the electrodes becomes larger. As a result, the ink is separated from the ink droplet formed on the ink discharge part and drops toward the printing object.

In a typical inkjet print head of electrostatic field induced type, a certain amount of voltage that is sufficient to keep the ink from discharging from the nozzle is constantly supplied between electrodes of each nozzle, and then apart from the constant voltage, a discharge voltage is additionally supplied for a specific nozzle that needs to discharge the ink, thereby individually driving each nozzle. For example, while a direct current voltage (or a bias voltage) of 1 kV is supplied as the constant voltage between electrodes of each nozzle, an alternating current voltage of 0.5 kV of a pulse type is added to the constant voltage only for some nozzle to be driven. It shall be evident that various other methods of supplying a voltage can be also employed.

Accordingly, while it is shown that the driving electric power 130 is implemented as one alternating current power in each of FIGS. 7*a* and 7*b*, respectively, it shall be understood that the driving electric power is only shown as a test electric power without any other implication. Driving circuit connection methods shown in FIGS. 7*a* and 7*b* should be also understood to be conceptual connection methods for an illustration or a test.

FIGS. 7*a* and 7*b* are illustrated with an assumption that each nozzle is individually driven by grounding the second electrode as a common electrode and individually supplying the driving voltage to the first electrode. Assuming the same connection method as described above, FIGS. 1 through 6 also illustrate an arrangement structure in which the second electrode is optimized for the connection method. In the mean time, it shall be evident that the connection can be reversed. In other words, it is possible to individually drive each nozzle by grounding the first electrode, which is formed in each nozzle, and individually supplying the driving voltage to the second electrode. In this case, it would be necessary to change the arrangement structure of the second electrode from that of FIGS. 1 through 6.

Figure 8C:
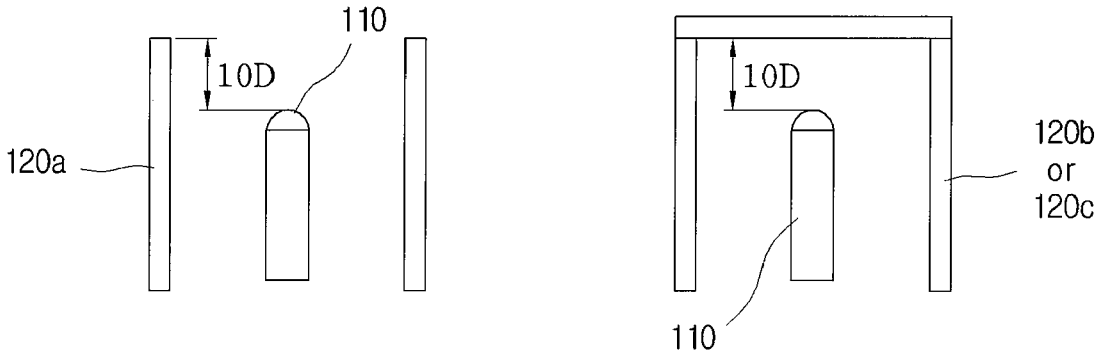
FIG. 8*c* shows electrode structures according to other embodiments of the present invention.
Figure 9:
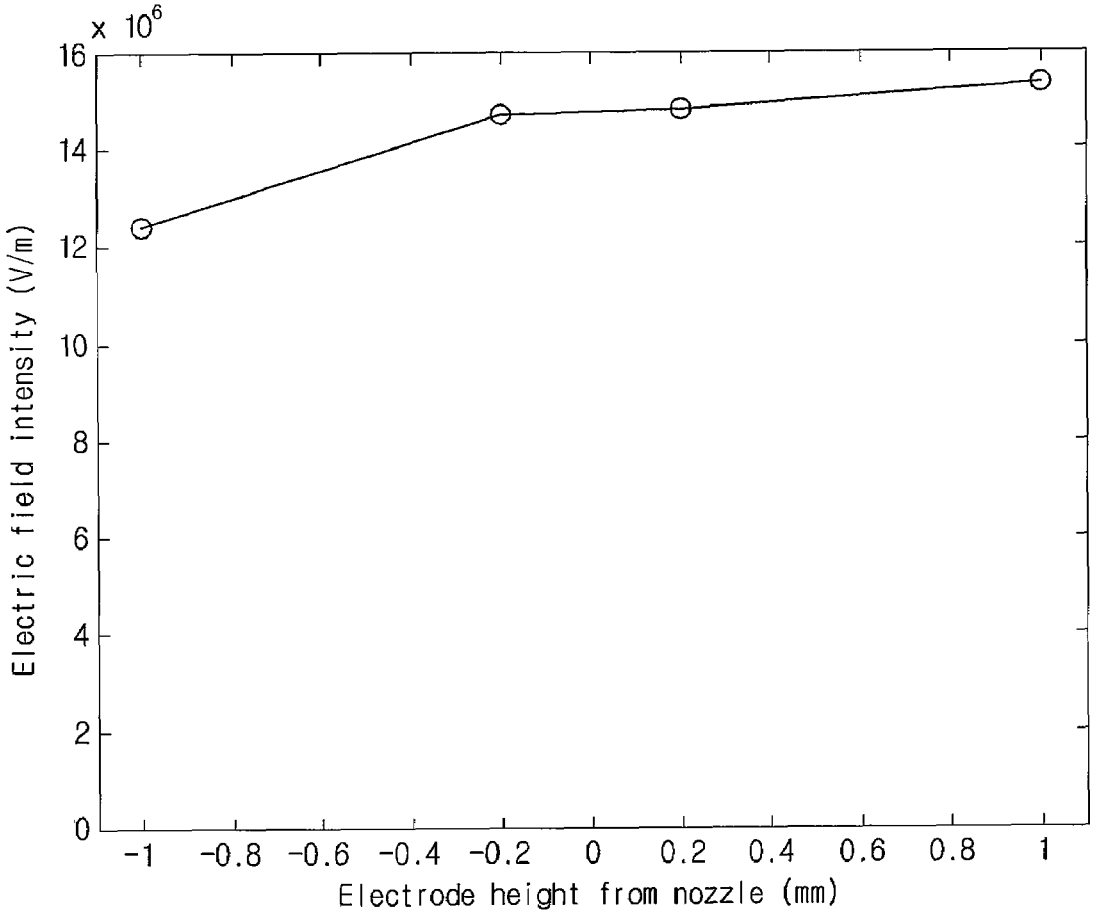
FIG. 9 is a graph showing an electric field intensity based on a height difference between electrodes in an electrode structure of an inkjet print head according to an embodiment of the present invention.

FIGS. 8*a* and 8*b* show a comparison of a conventional electrode structure of an inkjet print head of an electrostatic field induced type and an electrode structure based on an embodiment of the present invention. FIG. 8*c* shows electrode structures according to other embodiments of the present invention. FIG. 9 is a graph showing an electric field intensity based on a height difference between electrodes in an electrode structure of an inkjet print head according to an embodiment of the present invention.

Each of left-side figures in FIGS. 8*a* and 8*b* shows the existing facing electrode structures. On the other hand, FIG. 8*c* and each of right-side figures in FIGS. 8*a* and 8*b* show various examples of the side electrode structure. Electrode structures shown in FIG. 8*c* may be also more profitable than those of FIGS. 8*a* and 8*b* in the side electrode structure of an embodiment of the present invention. This can be easily cleared through a graph of FIG. 9, which shows an electric field intensity based on a height difference between electrodes.

In the graph of FIG. 9, the horizontal axis represents a height difference the second electrode and the end in the ink discharge direction of the nozzle on the basis of the end. The vertical axis represents an electric field intensity. Here, the negative values of the horizontal axis signify that the end of the nozzle is located higher than the end of the second electrode is. The positive values of the horizontal axis signify that the end of the nozzle is located lower than the end of the second electrode is. In FIG. 9, it can be seen that when the end of the nozzle is located lower than the end of the second electrode is (that is, see FIG. 8*c*), the electric field intensity being formed between electrodes (that is, a magnitude of an electrostatic attraction) is larger. This shows that it is advantageous from the viewpoint of an electric field efficiency to design such that the end of the nozzle is located lower than the end of the second electrode under the same condition (that is, if the same driving voltage is supplied between the electrodes).

Hereinafter, through the simulation results of FIGS. 10*a* and 10*b*, it is understood that the present invention fully prevents crosstalk caused by the electric field interference between adjacent nozzles.

FIGS. 10*a* and 10*b* show simulation results of an electric field lines distribution appearing when operating a nozzle in an inkjet print head according to an embodiment of the present invention. FIG. 10*a* shows that adjacent nozzles are driven in an on-off-on state. FIG. 10*b* shows that adjacent nozzles are driven in an on-on-on state.

In the electric field lines distribution formed between the electrodes of each nozzle in not only the on-off-on state of FIG. 10*a* but also the on-on-on state of FIG. 10*b*, the electric field lines are blocked by the second electrode functioning as a shielding wall. Accordingly, it is apparently seen that two adjacent nozzles are not influenced by the electric field interference.

As such, according to the present invention, the electric field interference between adjacent nozzles is shielded by using the side electrode structure by the first electrode formed in each of the nozzles and the second electrode located on multi-sides of the nozzles. Accordingly, crosstalk can be prevented.

While the present invention has been described with reference to embodiments thereof, it will be easily understood by those skilled in the art that various changes and modification in forms and details may be made without departing from the spirit and scope of the present invention as defined by the appended claims.

What is claimed is:

1. An inkjet print head of electrostatic field induced type, which has a plurality of nozzles, the inkjet print head comprising:

a first electrode being formed in each nozzle; and a second electrode located on a side spaced from the nozzle and arranged to block between any two adjacent nozzles and inducing an electrostatic field for discharging ink from the nozzle by forming an electric potential difference between the first electrode and the second electrode.

2. The inkjet print head of claim 1, wherein the second electrode is located on both sides spaced from the nozzle.

3. The inkjet print head of claim 1, wherein the second electrode is arranged to surround the sides of the nozzle from every direction.

4. The inkjet print head of claim 3, wherein the second electrode is manufactured to have a rectangular pillar shape.

5. The inkjet print head of claim 3, wherein the second electrode is manufactured to have a cylindrical shape around the nozzle, the cylindrical shape having an identical radius.

6. The inkjet print head of claim 1, wherein the second electrode is also located on the front side of the nozzle, whereas an opening is formed at a part of the second electrode located on the front side of the nozzle, the part corresponding to a position of an ink discharge port of the nozzle.

7. The inkjet print head of claim 1, wherein an end of the nozzle in a direction of discharging the ink is located to be lower than an end of the second electrode.

8. The inkjet print head of claim 1, wherein the first electrode is formed by coating at least a part of a surface of the nozzle with a conductive material.

9. The inkjet print head of claim 1, wherein the first electrode is formed by manufacturing at least a part of the nozzle with a conductive material.

10. The inkjet print head of claim 1, further comprising a driving circuit for supplying a driving electric power to the first electrode and the second electrode, whereas the driving circuit individually supplies a discharge voltage for discharging the ink to the first electrode for each nozzle and supplies a ground voltage to the second electrode.

11. The inkjet print head of claim 1, further comprising a driving circuit for supplying a driving electric power to the first electrode and the second electrode, whereas the driving circuit individually supplies a discharge voltage for discharging the ink to the second electrode for each nozzle and supplies a ground voltage to the first electrode.

12. The inkjet print head of claim 1, wherein the plurality of the nozzles are arranged in a line spaced from one another at regular intervals.

13. The inkjet print head of claim 1, wherein the plurality of the nozzles are two-dimensionally arranged to be spaced from one another.

14. An inkjet print head of electrostatic field induced type, which has a plurality of nozzles, the inkjet print head comprising:

a first electrode formed to be in contact with ink to be discharged through the nozzle; and a second electrode located on a side spaced from the nozzle and arranged to block between any two adjacent nozzles and inducing an electrostatic field for discharging ink from the nozzle by forming an electric potential difference between the first electrode and the second electrode.

15. The inkjet print head of claim 14, wherein the second electrode is located on both sides spaced from the nozzle.

16. The inkjet print head of claim 14, wherein the second electrode is arranged to surround the sides of the nozzle from every direction.

17. The inkjet print head of claim 16, wherein the second electrode is manufactured to have a rectangular pillar shape.

18. The inkjet print head of claim 16, wherein the second electrode is manufactured to have a cylindrical shape around the nozzle, the cylindrical shape having an identical radius.

19. The inkjet print head of claim 14, wherein the second electrode is also located on the front side of the nozzle, whereas an opening is formed at a part of the second electrode located on the front side of the nozzle, the part corresponding to a position of an ink discharge port of the nozzle.

20. The inkjet print head of claim 14, wherein an end of the nozzle in a direction of discharging the ink is located to be lower than an end of the second electrode.

21. The inkjet print head of claim 14, further comprising a driving circuit for supplying a driving electric power to the first electrode and the second electrode, whereas the driving circuit individually supplies a discharge voltage for discharging the ink to the first electrode for each nozzle and supplies a ground voltage to the second electrode.

22. The inkjet print head of claim 14, further comprising a driving circuit for supplying a driving electric power to the first electrode and the second electrode, whereas the driving circuit individually supplies a discharge voltage for discharging the ink to the second electrode for each nozzle and supplies a ground voltage to the first electrode.

23. The inkjet print head of claim 14, wherein the first electrode is disposed for each nozzle.

24. The inkjet print head of claim 14, wherein the plurality of the nozzles are arranged in a line spaced from one another at regular intervals.

25. The inkjet print head of claim 14, wherein the plurality of the nozzles are two-dimensionally arranged to be spaced from one another.

* * * * *